US006286734B1

(12) United States Patent
Schneider

(10) Patent No.: US 6,286,734 B1
(45) Date of Patent: Sep. 11, 2001

(54) CLOTHES HANGER WITH A PANTS HOLDING DEVICE

(76) Inventor: Kurt Schneider, Goethestrasse 11, D-73540 Heubach (DE)

( * ) Notice: Subject to any disclaimer, the term of this patent is extended or adjusted under 35 U.S.C. 154(b) by 0 days.

(21) Appl. No.: 09/297,553

(22) PCT Filed: Nov. 6, 1997

(86) PCT No.: PCT/EP97/06161

§ 371 Date: Feb. 18, 2000

§ 102(e) Date: Feb. 18, 2000

(87) PCT Pub. No.: WO98/20781

PCT Pub. Date: May 22, 1998

(30) Foreign Application Priority Data

| | | |
|---|---|---|
| Nov. 9, 1996 | (DE) | 196 46 256 |
| Nov. 24, 1996 | (DE) | 196 48 533 |
| May 21, 1997 | (DE) | 197 21 264 |
| Aug. 19, 1997 | (DE) | 197 35 907 |

(51) Int. Cl.[7] ..... A47G 25/48
(52) U.S. Cl. ..... 223/93; 223/96; 223/91
(58) Field of Search ..... 223/90, 91, 93, 223/85, 96; D6/326

(56) References Cited

U.S. PATENT DOCUMENTS

| | | | | |
|---|---|---|---|---|
| 2,377,218 | * | 5/1945 | Ellis | 223/96 |
| 2,490,475 | * | 12/1949 | Rosenberg | 223/96 |
| 2,886,224 | * | 5/1959 | Bourne | 223/96 |
| 2,998,173 | * | 8/1961 | Lutz | 223/96 |
| 3,260,427 | * | 7/1966 | Ginger | 223/96 |
| 3,692,216 | * | 9/1972 | Becca | 223/96 |
| 5,775,554 | * | 7/1998 | Taylor | 223/96 |

FOREIGN PATENT DOCUMENTS

| | | | |
|---|---|---|---|
| 1067465 | 12/1979 | (CA) | A47J/51/14 |
| 222762 | 11/1942 | (CH) . | |
| 20 55 418.1 | 6/1971 | (DE) | A47J/51/14 |
| 828080 | 2/1960 | (GB) . | |

* cited by examiner

*Primary Examiner*—Bibhu Mohanty
(74) *Attorney, Agent, or Firm*—Randall J. Knuth

(57) ABSTRACT

A clothes hanger with a pants holding device comprising a shoulder contour segment with a hook, a cross bar between the arms of the shoulder contour segment and a flexible spring element which is attached to the pants holding device. The spring element extends somewhat parallel to the cross bar and is held in place by means of interlocking openings. The spring element can be moved between a release position and a clamping position, wherein the pants are firmly clamped between the cross bar and the spring element in the clamping position. In order to design the pants holding device with an economy of means and long-lasting efficiency, to securely retain the spring element in the clamping position and in the release position and to enable troublefree switching of the spring element from one position to the other, the ends of the spring element are held in the interlocking openings by forming a joint having a substantially stationary rotating axis.

26 Claims, 7 Drawing Sheets

CLOTHES HANGER WITH A PANTS HOLDING DEVICE

The invention is relative to a clothes hanger with a pants holding device.

Such a clothes hanger is known from U.S. Pat. No. 1,206,348. The clothes hanger of this publication comprises a shoulder contour part with a hook. The shoulder contour part serves to receive a jacket or a similar piece of clothing. A crosspiece is clamped between the arms of the shoulder contour part across which crosspiece a pair of pants can be hung. In order to prevent the pants from sliding off unintentionally a spring element is provided which also extends between the arms of the shoulder contour part and runs approximately parallel to the crosspiece. The spring element is flexibly designed and can move back and forth between a clamping position holding the pants and a release position. The ends of the spring element are received in bearing openings with a polygonal cross section on the arms of the shoulder contour part.

This clothes hanger has the disadvantage that a given release position and clamping position of the spring element can not be reliably maintained over time. Conditioned by the cross-sectional form of the bearing opening, an end section of the spring element is supported by a side surface in the release position on an upper outer edge of the bearing opening but in the clamping position on the opposite lower outer edge of the bearing opening. When being moved from one position to the other position and during the snap movement associated therewith the flexible spring element first rotates about the support point on the particular outer edge of bearing opening until the spring element has been bent so far that it automatically jumps into the new position. During the change of position the spring element strikes the opposite outer edge of the bearing opening. This strain results in increased wear to the point where it loses its ability to function.

On account of the bending the spring element has a high internal tension which can result in an uncontrolled, sudden snapping back during the adjustment of the spring element from the release position to the clamping position. This too can result in the inability of the pants holding device to function and also involves the danger of injury.

The invention is based on the problem of developing the pants holding device with simple means so that it functions reliably and permanently, of reliably holding the spring element in the clamping position and in the release position and of making it possible to move the spring element from one position to the other position without problems; in addition, the possibility should be created of providing clothes hangers with simple means with a pants holding device.

This problem is solved in accordance with the invention with the features of claim 1, 16 and 23.

A defined, controlled movement of the spring element during the passage from one position to the other is given by the essentially stationary axis of rotation. The bearing and the particular end of the spring element form an articulation without further components being necessary.

The axis of rotation is purposefully located directly on the bearing bottom and as a result the support point and the point of rotation coincide.

According to an advantageous embodiment the ends of the spring element rest in both positions on the bearing side surfaces of a V-shaped bearing engagement opening. The V-shaped design of the bearing makes it possible to adjust with simple means the aperture angle as a function of the structural conditions. Depending on the length of the spring element, the nature of the material and the distance of the spring element from the crosspiece, an aperture angle can be selected by the selection of the bearing which angle permits a deflection of varying intensity of the spring element from the ideal line with a distribution of tension adapted appropriately to the material, the geometry and the function. An uncontrolled changing between the two positions is avoided because the bearing side surfaces support the ends of the spring element and contribute in this manner to stabilization.

An aperture angle of approximately 20° to 80° has proven to be advantageous; the ends of the spring element rest in a stable manner on the bearing side surfaces within this angular range.

A groove can be provided on the bearing bottom into which groove the ends of the spring element are received. The ends of the spring element can be clamped into the groove, especially if the cross section of the groove is adapted to the cross section of the spring element; the possibility of the spring element moving between the two defined positions is not limited thereby. The spring element is prevented from coming loose out of the bearing in an unintentional manner.

Another advantageous development provides that the engagement opening has a rounded, especially a circular or partially circular cross section with a cross-sectional axis orthogonal to the longitudinal axis of the spring element. A curved end of the spring element can be suspended in this opening, which curved end forms the bearing axis.

The spring element advantageously consists of a spring band steel such as, e.g., high-grade steel and is continuous, thus, without interruption and advantageously without a kink and preferably has a constant cross section over its entire length. This standard structural component is economical and functions reliably.

The problem on which the invention is based can also be solved in that a centrally arranged, reinforced holding middle piece [middle holding piece] is provided on the spring element which middle piece has a greater bending resistance than the spring element. The holding middle piece contributes to stabilization in both positions and, in addition, assumes ergonomic functions. The holding middle piece effects a stiffening of the spring element in the middle range which prevents a corrugated forming of the spring element, especially during the passage from the release position into the end position and inversely, and also prevents other stable but undesired positions. In the clamping position the spring element rests areally on the crosspiece in the area of the holding middle piece and exerts a uniform pressure over the length of the holding middle piece on the pants to be clamped fast. A punctual loading, which can lead to a sliding of the pants, is avoided.

The holding middle piece can be provided with a finger catch [catch area, engagement area] for reliable and comfortable manipulation in order to simplify the moving from one position to the other. Furthermore, a middle recess can be present on the side facing the crosspiece in order to leave room for thick seams of the pants handing over the crosspiece.

In order to equip clothes hangers with simple means with a pants holding device it is provided that the cross piece and the spring element can be designed as an independent pants holding module. The pants holding module can be manufactured independently of the clothes hanger and subsequently mounted on the clothes hanger. The clothes hanger can be subsequently provided with the pants holding module or also be equipped with a connecting unit for the pants holding module during the manufacture already.

The crosspiece is advantageously manufactured either from plastic or from metal. In the case of a crosspiece manufactured from plastic the bearings provided for holding the spring band purposefully consist of plastic and are injected into the crosspiece. In the case of a crosspiece manufactured from metal the bearings are designed as independent plastic bearings which can be inserted into punched-out openings in the crosspiece.

The connection between the clothes hanger and the pants holding module preferably takes place by means of the engagement of the ends of the crosspiece into slots fashioned on the bottom of the arms of the shoulder contour part. The ends of the crosspiece are preferably designed in the form of shanks to this end and stand vertically in relation to the longitudinal axis of the crosspiece, that is, they face upward and can be easily inserted into the slots.

Figure 3:
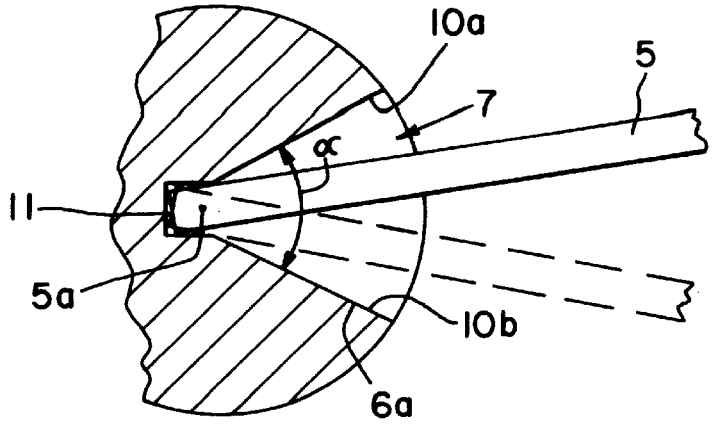
FIG. 3 shows an enlarged view of a bearing.
Figure 3A:
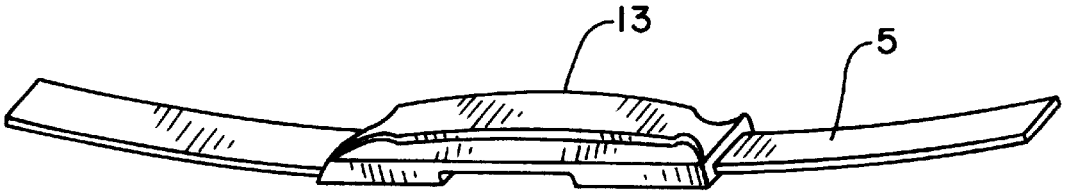
Figure 3B:
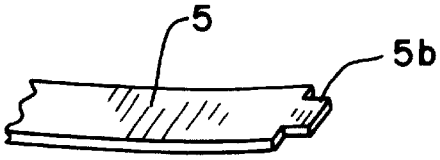

FIGS. 3*a*, 3*b* show embodiments of the spring element as a spring band.

Figure 4A:
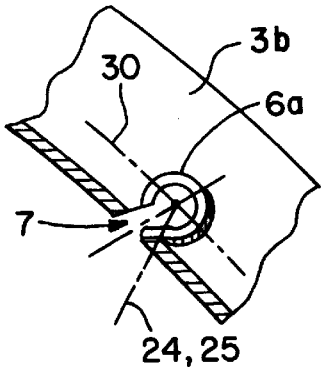
Figure 4B:
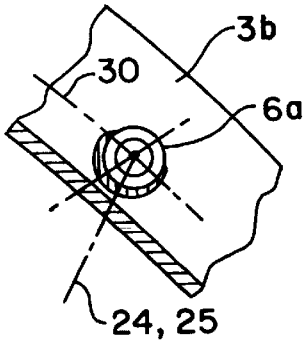

FIGS. 4*a*, 4*b* show variants of embodiments of engagement openings in the shoulder contour part.

Figure 4C:
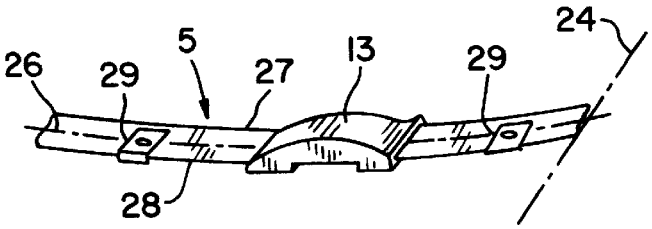
Figure 4D:
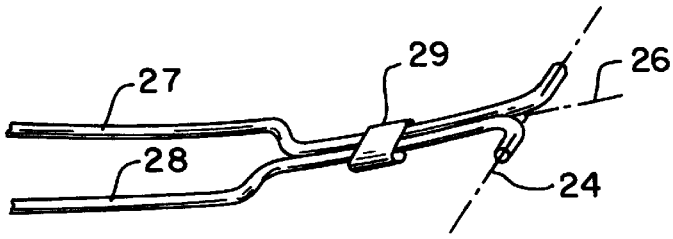
Figure 4F:
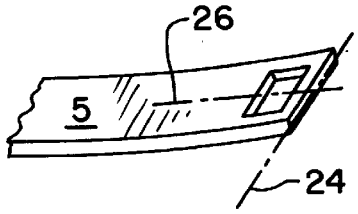
Figure 4G:
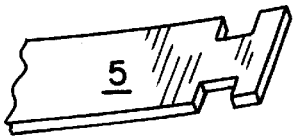
Figure 4E:
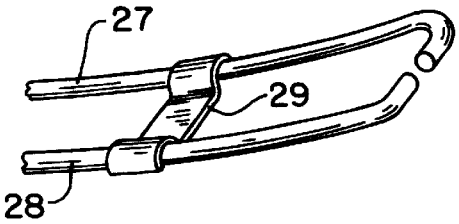

FIGS. 4*c*, 4*d*, 4*e* show embodiments of the spring element as a wire spring.

Figure 4H:
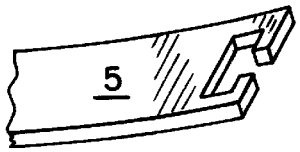

FIGS. 4*f*, 4*g*, 4*h* show further embodiments of the spring element as a spring band.

Figure 5A:
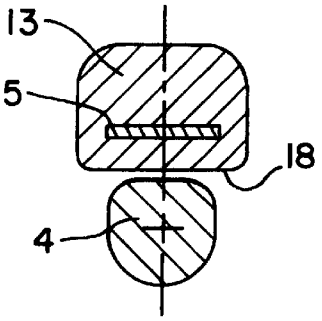
Figure 5B:
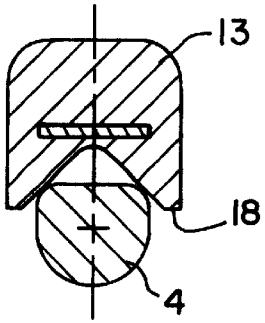
Figure 5C:
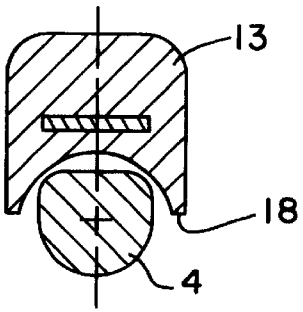

FIGS. 5*a*, 5*b*, 5*c* each show a section though the spring element and the crosspiece.

Figure 6:
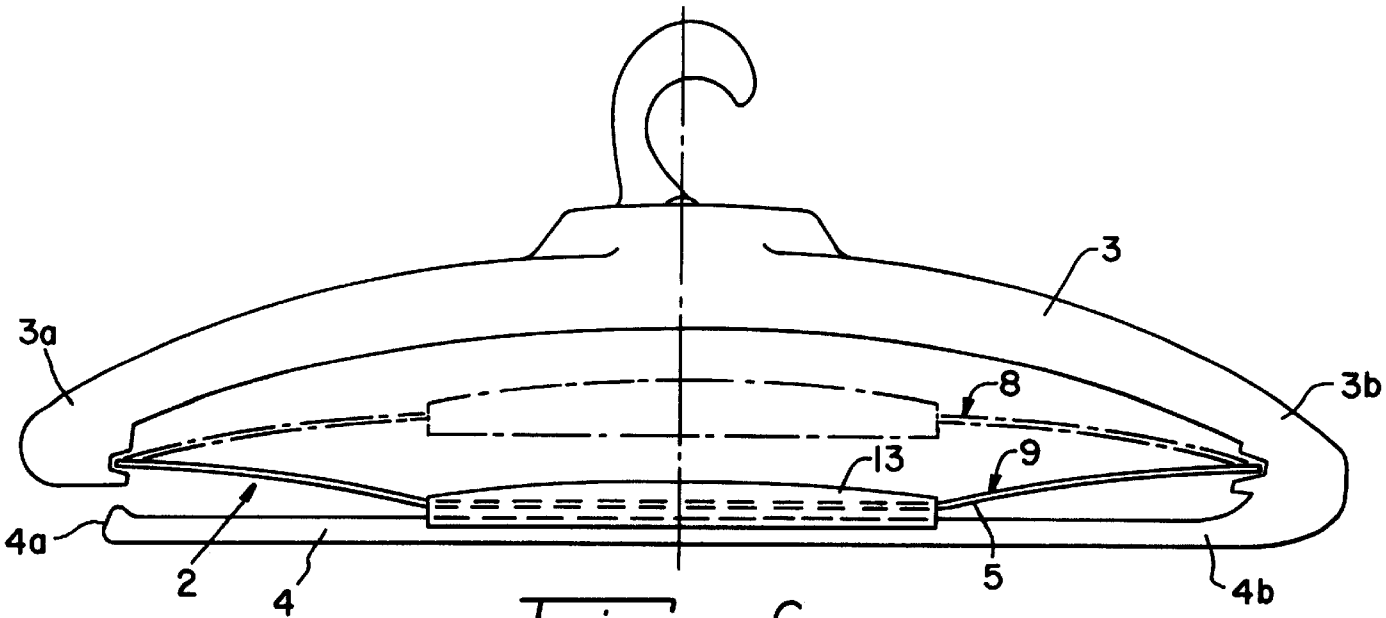

FIG. 6 shows another embodiment of the clothes hanger.

Figure 7:
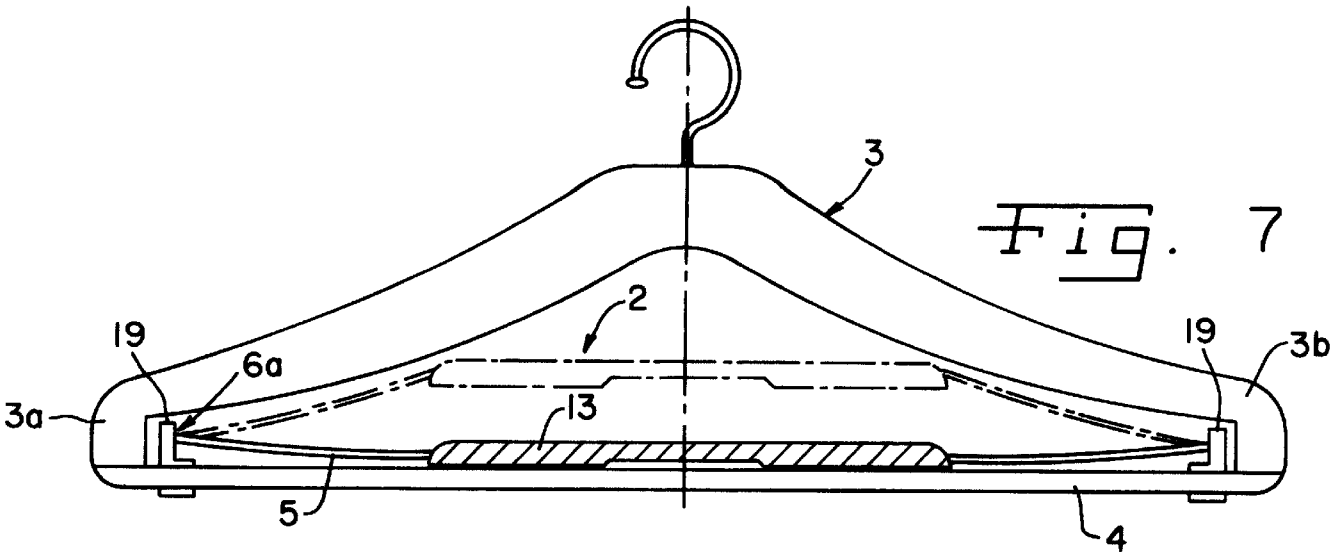

FIG. 7 shows yet another embodiment of the clothes hanger.

Figure 8:
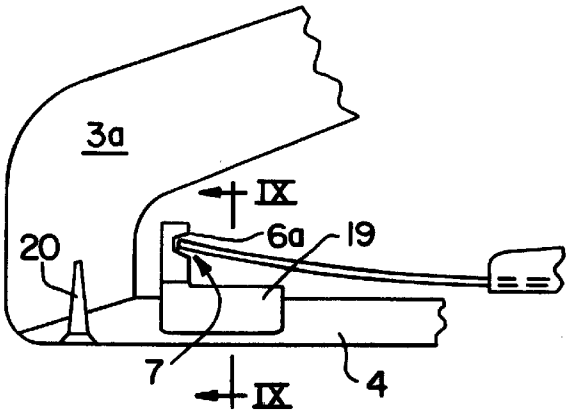

FIG. 8 shows an enlargement of a cutaway portion of FIG. 7.

Figure 9:
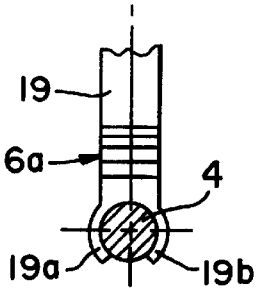

FIG. 9 shows a view along section [cut] line IX—IX in FIG. 8.

Figure 10:
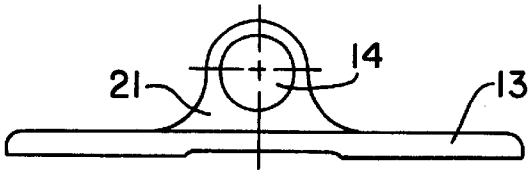

FIG. 10 shows a holding middle piece in another embodiment.

Figure 11:
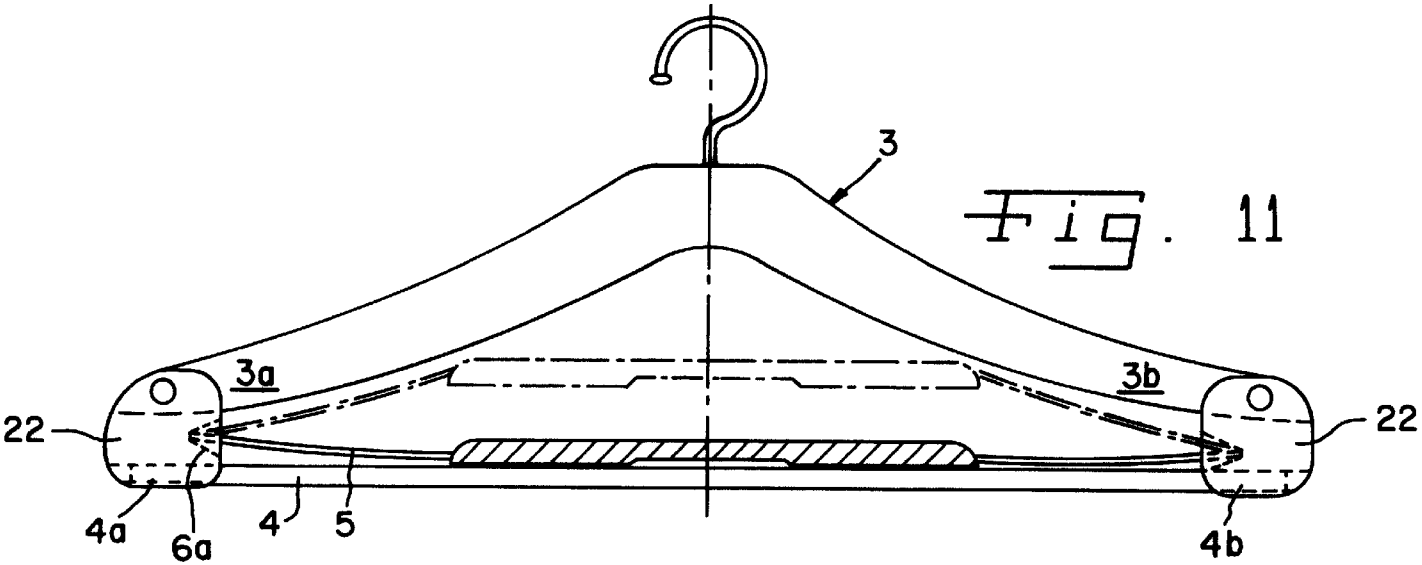

FIG. 11 shows yet another embodiment of the clothes hanger.

Figure 12:
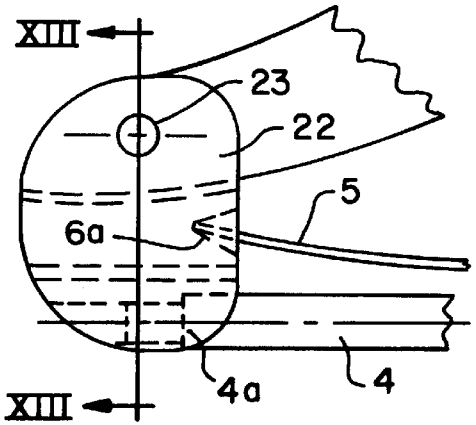

FIG. 12 shows a an enlargement of a cutaway portion of FIG. 11.

Figure 13:
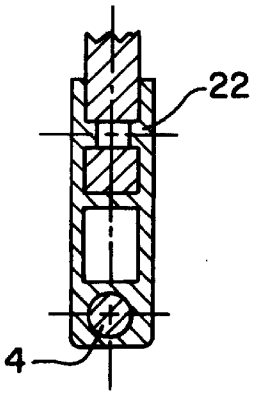

FIG. 13 shows a view along section line XIII—XIII in FIG. 12.

Figures 14, 15A, 15B, 16A, 16B:
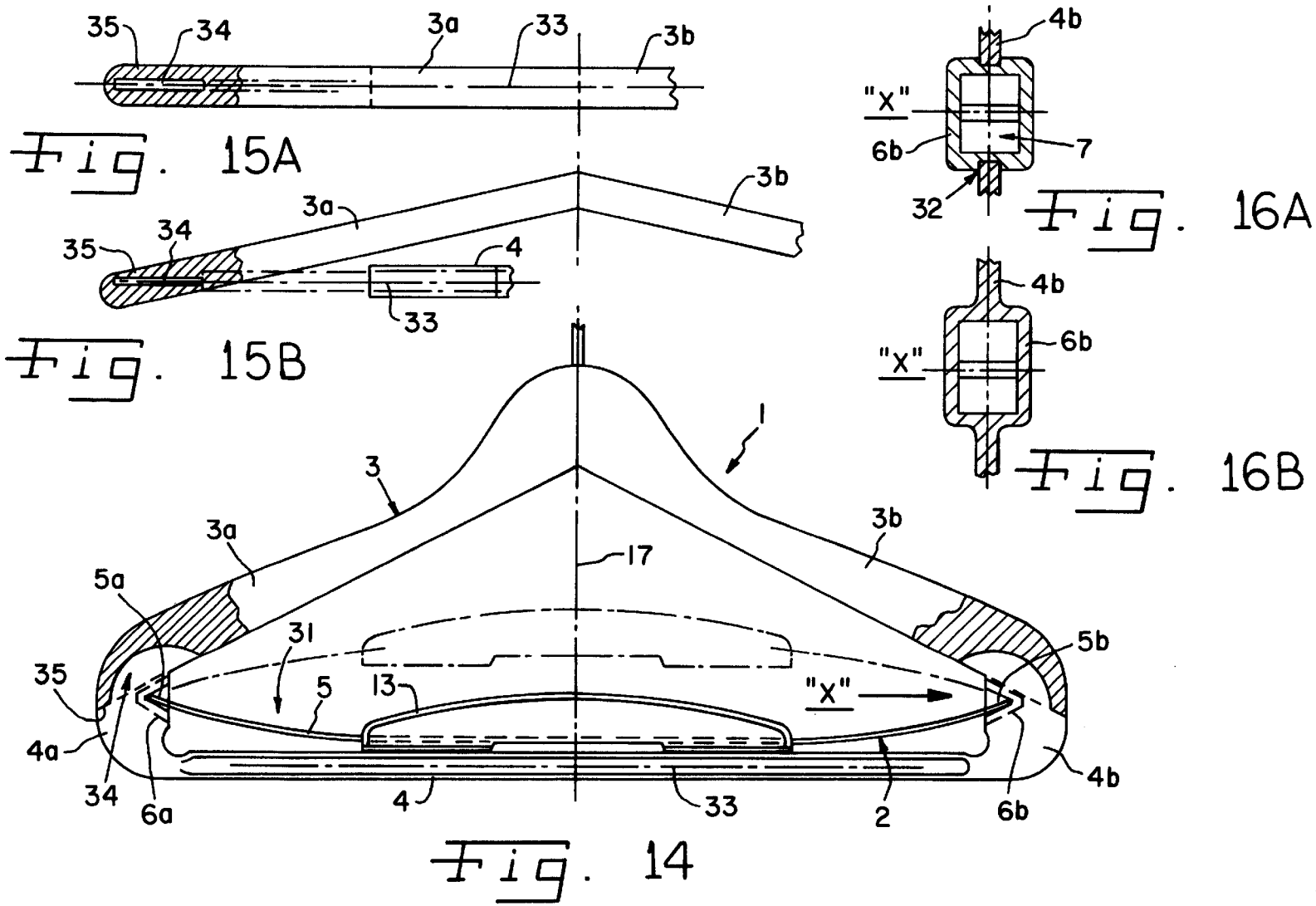

FIG. 14 shows another embodiment of the clothes hanger.

FIG. 15*a* shows a top view of the clothes hanger of FIG. 14 in a first variant.

FIG. 15*b* shows a top view of the clothes hanger of FIG. 14 in a second variant.

FIG. 16*a* shows detail "X" of FIG. 14 in a first variant.

FIG. 16*b* shows detail "X" of FIG. 14 in a second variant.

Figure 1:
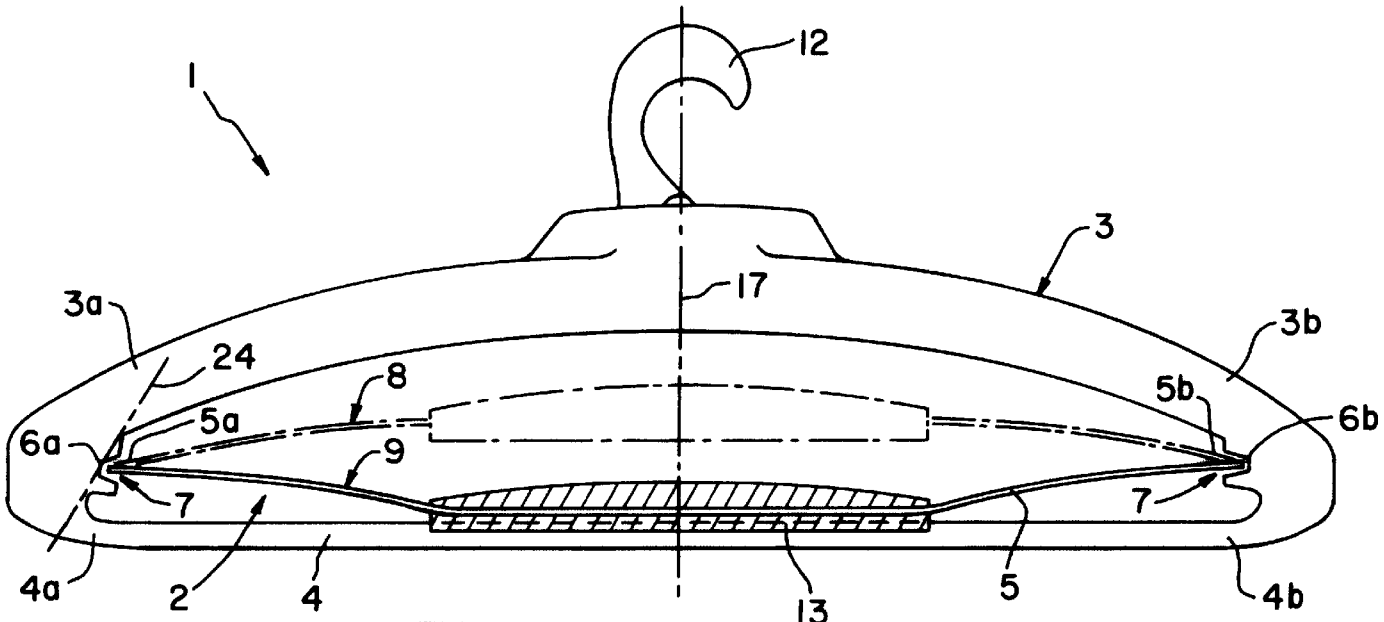
FIG. 1 shows a side view of the clothes hanger in accordance with the invention.

According to FIG. 1 the clothes hanger 1 consists of shoulder contour part 3 with slightly bent alms 3*a*, 3*b* falling off laterally, of book 12, crosspiece 4 between the end sections of arms 3*a*, 3*b* as well as of pants holding device 2. Pants holding device 2 comprises spring element 5 which is arranged between shoulder contour part 3 and crosspiece 4 and whose ends 5*a*, 5*b* are received in bearings 6. Bearings 6 are arranged in the area of the end sections of arms 3*a*, 3*b* of shoulder contour part 3 on the inside, so that spring element 5 attacks the shoulder contour part directly. Each bearing 6 has an engagement opening 7 into which an end 5*a* or 5*b* of spring element 5 is inserted. Furthermore, holding middle piece 13 is provided on spring element 5. Pants holding device 2 is designed symmetrically to central bisectrix. Crosspiece 4 is designed integrally with shoulder contour part 3 and connected at both ends 4*a*, 4*b* to arms 3*a*, 3*b* of the shoulder contour part.

Spring element 5 extending approximately parallel to cross piece 4 can move back and forth between release position 8 and clamping position 9. In release position 8 the pants can be placed over crosspiece 4 or removed from it. In clamping position 9 the pants are clamped fast between spring element 5 and crosspiece 4.

Spring element 5 can bend elastically orthogonally to its longitudinal plane. The length of spring element 5 exceeds the interval between the two opposite engagement openings; the spring element therefore stands under internal tension and assumes a stable position only either in release position 8 or in clamping position 9. The release position and the clamping position are located somewhat above and below an imaginary ideal line running between the bearings which ideal line extends parallel to the crosspiece and within the inner surface limited by shoulder contour part 3 and crosspiece 4.

Ends 5*a*, 5*b* of spring element 5 rest on the bottom of engagement opening 7 and are supported there. Engagement opening 7 and the particular spring-element end 5*a*, 5*b* form an articulation with essentially stationary axis of rotation 24 located directly on the bearing bottom (FIG. 1).

Figure 2:
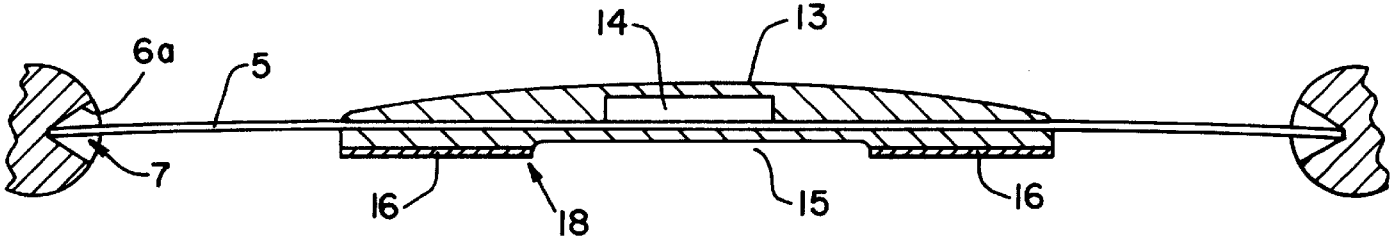
FIG. 2 shows a side view of the spring element.

The stability in the two positions of the spring element is supported by the form of bearing 6, whose engagement openings 7 are designed somewhat V-shaped according to FIGS. 2, 3 and open toward spring element 5. Aperture angle $\alpha$ of engagement openings 7 can be between approximately 20° and 80°. In the exemplary embodiment the aperture angle is approximately 50° to 60°.

Bearing side surfaces 10*a*, 10*b* are formed by the V shape of engagement opening 7 which side surfaces function as stop faces for the end sections of spring element 5. In the release position the end section of the spring element rests on upper bearing side surface 10*a* and in the clamping position on lower bearing side surface 10*b*. Bearing side surfaces 10*a*, 10*b* support spring element 5 and contribute to stabilization. This avoids an uncontrolled snapping back and forth of the spring element.

Even holding middle piece 13, which is centrally fastened on the spring element, contributes to the stabilization. The holding middle piece has a significantly greater bending resistance than the soft spring element and as a result stiffens the middle area of the spring element. On the other hand, the edge areas of the spring element remain uninfluenced on account of the shorter length of the holding middle piece in comparison to the spring element.

It can also be gathered from FIG. 2 that holding middle piece 13 has a central recess 15 on the bottom facing the crosspiece. The middle recess creates room for the seam of a pair of pants clamped fast, so that an areal clamping fast becomes possible and a punctual clamping fast is avoided. Holding middle piece 13 is provided on both sides of central recess on bottom 18 with anti-slide element or anti-slide coating 16 with which an unintentional sliding off of the pants is prevented. The anti-slide element clamps the pants fast on account of high friction and has, e.g., a rubber coating on the side facing the crosspiece. Since the holding middle piece does not bend, the two anti-slide elements lie on top in a line and areally in the clamping position and clamp the pants reliably in.

Furthermore, holding middle piece 13 is provided above spring element 5 with a finger catch 14 which catch makes possible a user-friendly shifting between the release position and the clamping position. Finger catch 14 has a rectangular cross section but can also run in a curve. Holding middle piece 13 is slightly crowned on its top.

Holding middle piece 13 is manufactured in a purposeful manner as an independent component of plastic and surrounds spring element 5, which can be inserted into a corresponding conduit or a groove in the holding middle piece open to crosspiece 4. It can also be purposeful to fasten the holding middle piece in that the two anti-slide elements 16 are designed as independent components but permanently connected to the holding middle piece, e.g., by adhesion or pins and that the spring element is clamped fast between the holding middle piece and the anti-slide elements. In both instances the holding middle piece is held fast on the spring element.

The bottom or base of bearing 6 is advantageously provided according to FIG. 3 with groove 11 whose cross section is the same as the cross section of the spring element. End 5*a* of spring element 5 is clamped into groove 11, which prevents spring element 5 from jumping out unintentionally out of bearing 6. The groove cross section and the cross section of the spring element are rectangular.

Spring element 5 consists with advantage of high-grade steel and can be designed as a spring band which extends continuously with constant cross section between the bearings. This spring band is distinguished by a high degree of elasticity and can be used for a long time without material fatigue. Holding middle piece 13, which is advantageously designed as a separate component and consists largely of non-elastic plastic, prevents a bending of the spring band in the area of the holding middle piece and, as a result, makes it possible to press the pants areally on the crosspiece At the same time holding middle piece 13 contributes to the stabilizing of the spring band in the release position and in the clamping position.

According to another embodiment the spring element and the holding middle piece are designed as a common component. Even in this embodiment the spring element can be designed as a spring band which, however, has a shape deviating from the end sections in the middle section by reshaping, welding it on, soldering it on or the like and is provided with the functions of the holding middle piece . Instead of consisting of metal the one-piece design can also be formed as an injection-molding part of plastic.

FIGS. 3*a* and 3*b* show different embodiments of spring element 5 designed as a spring band which can be used in particular in conjunction with the V-shaped bearing according to FIGS. 2 and 3. According to FIG. 3*a* the spring band of the spring element is designed rectangularly, viewed from the top. According to FIG. 3*b*, end 5*b* of the spring element comprises punched-out corners so that a projection with a small width is given which can engage into a corresponding groove 11 at the bottom of bearing 6.

FIGS. 4*a* and 4*b* show variants of embodiments of engagement openings 7 on arm 3*a* of the shoulder contour part. Engagement openings 7 are circular or partially circular and have cross-sectional axis 25 running advantageously orthogonally to longitudinal axis 30 of am 3*b* of the shoulder contour part. Moreover, cross-sectional axis 25 is also arranged orthogonally to longitudinal axis 26 of spring element 5 (FIG. 4*c*). Engagement opening 7 is either interrupted in the direction of the inner side of the shoulder contour part according to FIG. 4*a* and thus forms an open round bearing, or is integrated according to FIG. 4*b* completely in the arm of the shoulder contour part (closed round bearing).

In both instances a design of spring element 5 according to FIGS. 4*c* to 4*h* is especially suited for engagement, during which the end of the spring element is clipped into the round bearing. FIGS. 4*c* to 4*e* show embodiments of the spring element as a wire spring and FIGS. 4*f* to 4*h* show embodiments as a spring band.

In the embodiments as a wire spring, spring element 5 comprises two parallel individual wires 27, 28 connected by connecting member 29, e.g., a plastic member. The end areas can either have a closed curved form, FIG. 4*c*, or be designed as open curved pieces [clamps, loops, clips], FIGS. 4*d* and 4*e*. In both instances axis of rotation 24 runs approximately vertically to longitudinal axis 26 of spring element 5. The open ends of the curved pieces are either T-shaped and face away from one another (FIG. 4*d*) or face one another (FIG. 4*e*).

The design as wire spring has the advantage that in the case of a second crosspiece which can be arranged above the first crosspiece 4 receiving the pants and can be provided, e.g., for ties, the bending line of the spring element in the release position can run higher than the second crosspiece; this is made possible in that in the release position the second crosspiece can be received in the intermediate space between the two individual wires 27 and 28 of spring element 5.

The embodiments as spring band according to FIGS. 4*f* to 4*h* are also suitable for an engagement into a round bearing according to FIGS. 4*a* and 4*b*. Recesses are provided in the end sections of the spring band via which recesses an engagement and a cooperation with bearing 6 is made possible.

FIGS. 5*a* to 5*c* show different cross-sectional forms of holding middle piece 13. According to FIG. 5*a* holding middle piece 13 has an approximately rectangular cross section with a plane bottom 18 facing crosspiece 4 and has rounded edges. According to FIG. 5*b* holding middle piece 13 is provided on bottom 18 with a V-shaped groove partially surrounding crosspiece 4 in the clamping position. A groove is also provided according to figure 5*c* on bottom 18 but with a semicircular cross section.

In all instances crosspiece 4 is plane on the side facing holding middle piece 13 and partially circular on the side facing away from the holding middle piece.

FIG. 6 shown another exemplary embodiment. Crosspiece 4 is open on one end 4*a* and connected to arm 3*b* of shoulder contour part 3*b* only on the opposite end 4*b*. This design has the advantage that the pants can be inserted laterally into and removed laterally from pants holding device 2.

FIGS. 7 to 9 show yet another exemplary embodiment which is especially suitable for retrofitting a pants holding device into a traditional clothes hanger. Pants holding device 2 is provided, as previously described, with spring element 5 and holding middle piece 13; however, bearings 6 are arranged on auxiliary elements 19 held directly on crosspiece 4. Thus, spring element 5 is held only indirectly on shoulder contour part 3. It can be gathered from the sectional enlargement of FIG. 8 that bearing 6 has V-shaped engagement opening 7 in the manner previously described, which opening is arranged on a section of auxiliary element 19 which section extends vertically. The bottom of the bearing is plane [level], so that a trapezoidal cross section of the engagement opening results.

As can be gathered from FIG. 9, auxiliary element 19 is provided with two partially circular walls 19*a*, 19*b* limiting a receiving groove and is thrust onto crosspiece 4. The auxiliary element can also be screwed on or connected in some other suitable manner to the crosspiece.

Crosspiece 4 is designed as an independent component which can be detached from shoulder contour part 3 and connected to arm 3*a* and/or 3*b* or shoulder contour part 3 by screw 20.

FIG. 10 shows holding middle piece 13, whose circular finger catch 14 sits on flange 21 on top of the holding middle piece.

FIGS. 11 to 13 show another exemplary embodiment. Crosspiece 4 is connected at both ends 4*a*, 4*b* by connecting element 22 to arms 3*a*, 3*b* of shoulder contour part 3. Connecting element 22 is also the carrier of bearing 6 for holding spring element 5. The connecting element is provided with a recess for receiving crosspiece 4; the connection to the arms of shoulder contour part 3 takes place via a hinge or screw connection 23.

FIGS. 14*a* to 16*b* show yet another exemplary embodiment. According to the lateral view of FIG. 14 clothes hanger 1, manufactured from wood or plastic, consists of shoulder contour part 3 with the two lateral arms 3*a* and 3*b*. Pants holding device 2, consisting of spring element 5 with holding middle piece 13, and crosspiece 4 form independent pants holding module 31 which is separate from shoulder contour part 3 and can be fastened to the shoulder contour part by suitable measures. To this end, ends 4*a*, 4*b* of crosspiece 4 each form a shank which extends vertically upward opposite longitudinal axis 33 of crosspiece 4 and engages into slot 34 on bottom 35 of arms 3*a*, 3*b* of shoulder contour part 3 (see also FIGS. 15*a*, 15*b*). Slot 34 and free, shank-like ends 4*a*, 4*b* of crosspiece 4 are curved. Ends 4*a*, 4*b* are held in slots 34 in an undetachable manner, especially by positive locking or material locking [incorporation into the material] such as clips, rivets, screws or adhesion. If applicable, a frictional grip can also be sufficient.

In the variant shown in FIG. 15*a* the shoulder contour part is provided with two arms 3*a*, 3*b* located in a plane. Longitudinal axis 33 of the crosspiece is in this instance at the same time the plane of the shoulder contour part and the slot plane of slot 34.

In the variant shown in FIG. 15*b* the two arms 3*a*, 3*b* of the shoulder contour part form an angle. Slot 34 is rotated by the same angle relative to the plane of an arm 3*a* or 3*b*; however, the dimensions of slot 34 are to be dimensioned in such a manner that the slot does not open to the outside on the lateral wall of the shoulder contour part.

Crosspiece 4 can be manufactured either from plastic or from metal. In the variant shown in FIG. 16*a* the crosspiece consists of metal and comprises plastic bearings 6 with engagement openings 7 for the ends of spring element 5. Openings 32 are placed in crosspiece 4 into which openings plastic bearings 6 are received. Round plastic bearings 6 can have an annular groove on their jacket surface to this end with which groove bearings 6 are clipped into openings 32.

In the variant shown in FIG. 16*b* the crosspiece is manufactured from plastic and bearing 6 is injected into the crosspiece.

Pants holding module 31, which forms a unit consisting of spring element 5 and crosspiece 4, assures an axially parallel alignment of crosspiece and spring element.

List of Reference Numerals

1 clothes hanger
2 pants holding device
3 shoulder contour part with arms 3*a*, 3*b*
4 crosspiece with ends 4*a*, 4*b*
5 spring element with ends Sa, 5*b*
6 bearing
7 engagement opening
8 release position
9 clamping position
10*a,b* bearing side surfaces
11 groove
12 hook
13 holding middle piece
14 finger catch
15 central recess
16 anfi-slide element
17 central bisectrix
18 bottom of the holding middle piece
19 auxiliary elements with walls 19*a*, 19*b*
20 screw
21 flange
22 connecting element
23 hinge, screw connection
24 axis of rotation
25 cross-sectional axis of the engagement opening
26 longitudinal axis of the spring element
27 wire
28 wire
29 connecting member
30 longitudinal axis of the shoulder contour part
31 pants holding module
32 opening
33 longitudinal axis
34 slot
35 bottom

What is claimed is:

1. A clothes hanger with a pants holding device for clamping pants, said clothes hanger comprising:

a hook;

a shoulder contour component having a first and second arm; each said arm contains an engagement opening which forms a first and second bearing, respectively, said hook affixed to said shoulder contour component;

a crosspiece between said arms;

a spring element having a first and second spring end and extending approximately parallel to said crosspiece, each said engagement opening open toward said spring element, said first and second spring end held in said first and second bearing free of restraint respectively, and forming an articulation having an essentially stationary axis of rotation, said spring element can move between a release position and a clamping position whereby, in said clamping position, the pants can be clamped between said crosspiece and said spring element; and a holding track piece associated with said spring element, said track has a lesser length than said spring element and which track has a greater bending resistance than said spring element, said track associated with the spring element in such a manner that a bending of said spring element is prevented in the area of the track, and length of the spring element is dimensioned so that it is under inherent tension and that the release position and the clamping position of said spring element are located above and below an ideal line imagined as running between the bearings and extending parallel to the crosspiece.

2. The clothes hanger according to claim 1, whereby said first and second bearings have a bearing bottom and said axis of rotation is located directly on the bearing bottom.

3. The clothes hanger according to claim 1, further comprising:

said engagement openings being approximately V-shaped which open toward said spring element; said engagement openings defining an aperture angle;

said first and second bearings having bearing side surfaces, which limit said aperture angle and form stop faces for said spring element when in said release position and in said clamping position.

4. The clothes hanger according to claim 3, wherein said aperture angle approximately 20° to 80°.

5. The clothes hanger according to claim 3, wherein said first and second bearings have a bearing bottom and each said bearing having a groove for receiving said first and second spring ends, respectively.

6. The clothes hanger according to claim 5, in which said groove has a cross section which is approximately the same as a cross section of said spring ends.

7. The clothes hanger according to claim 1, further comprising:

said spring element having a longitudinal axis; and said engagement opening having a rounded cross section and an engagement cross-sectional axis, said engagement cross-sectional axis running approximately orthogonally to said longitudinal axis.

8. The clothes hanger according to claim 7, in which said engagement opening is interrupted in a direction of the inside of said shoulder contour component.

9. The clothes hanger according to claim 7, in which said bearings have bearing walls which completely surrounded said engagement opening.

10. The clothes hanger according to claim 7, in which said spring ends are designed as curved pieces passing through said engagement opening.

11. The clothes hanger according to claim 1, in which said spring element is continuous.

12. The clothes hanger according to claim 1, in which said spring element consists of a spring band.

13. The clothes hanger according to claim 12, whereby said spring element has a constant, cross section over its entire length.

14. The clothes hanger according to one of claim 1, wherein said spring element is designed as a wire spring, said wire spring having two parallel wires connected to one another.

15. The clothes hanger according to claim 1, wherein the pants holding device is symmetrical about a midline of the clothes hanger.

16. A clothes hanger with a pants holding device for clamping pants, said clothes hanger comprising:

a spring element having ends, said spring element having a clamping position and a release position;

a crosspiece including bearings in the area of its ends which bearings have engagement openings for supporting the ends of the spring element, said engagement openings open toward the spring element so that the ends of said spring element are free of restraints; and a track associated with the spring element, said track having a lesser length than the spring element, said track having a greater bending resistance than said spring element, said track associated with said spring element in such a manner that a bending of said spring element is prevented in the area of said track, while the length of said spring element is dimensioned in such a manner that it is under inherent tension and that the release position and the clamping position of the spring element are located above and below an ideal line imagined as running between the bearings and extending parallel to the crosspiece.

17. The clothes hanger according to claim 16 wherein said track is contains a finger catch.

18. The clothes hanger according to claim 16, wherein said track further comprises a central recess having an opening toward said crosspiece.

19. The clothes hanger according to claim 16 further comprising:

an anti-slide element; and said track has a side facing said crosspiece, said anti-slide element located on said side.

20. The clothes hanger according to claim 16, in which said track is a formed as an independent component from said spring element and said track connected to said spring element.

21. The clothes hanger according to claim 16, in which said track and said spring element are formed as a single piece.

22. The clothes hanger according to claim 1, wherein said aperture angle approximately 50° to 60°.

23. The clothes hanger according to claim 8, in which said spring are designed as curved pieces passing through said engagement opening.

24. The clothes hanger according to claim 9, in which said spring are designed as curved pieces passing through said engagement opening.

25. The clothes hanger according claim 12 whereby said spring element consists of a spring band.

26. The clothes hanger according claim 20 whereby said middle holding piece is composed of plastic.

* * * * *